US008938861B1

(12) United States Patent
McLendon

(10) Patent No.: US 8,938,861 B1
(45) Date of Patent: Jan. 27, 2015

(54) REMOVABLY ATTACHABLE BUTTON

(76) Inventor: Shan McLendon, Crowley, TX (US)

( * ) Notice: Subject to any disclaimer, the term of this patent is extended or adjusted under 35 U.S.C. 154(b) by 120 days.

(21) Appl. No.: 13/211,157

(22) Filed: Aug. 16, 2011

Related U.S. Application Data

(60) Provisional application No. 61/374,142, filed on Aug. 16, 2010.

(51) Int. Cl.
*A44B 1/00* (2006.01)
*A44B 1/18* (2006.01)

(52) U.S. Cl.
CPC ..... *A44B 1/185* (2013.01)
USPC ..... 24/103; 24/104; 24/114.7

(58) Field of Classification Search
CPC ..... A44B 1/185; A44B 1/28; A44B 1/36; A44B 1/32; A44B 1/44; A44B 1/08; A44B 1/24; A44B 1/42; A44B 5/002; A44B 9/12; A41H 37/008; A41F 19/00; A44C 3/001; B29C 33/0022; B29C 45/14565
USPC ..... 24/103, 104, 114.3, 114.7, 114.12
See application file for complete search history.

(56) References Cited

U.S. PATENT DOCUMENTS

| | | | | | |
|---|---|---|---|---|---|
| 1,845,737 | A | * | 2/1932 | Austin | 24/103 |
| 2,643,427 | A | * | 6/1953 | Kenyon | 24/104 |
| 2,688,782 | A | * | 9/1954 | Hayden | 24/104 |
| 2,804,668 | A | * | 9/1957 | Rubenstein | 24/103 |
| 2,856,666 | A | * | 10/1958 | Crothers | 24/546 |
| 2,873,498 | A | * | 2/1959 | Naas | 24/103 |
| 2,874,433 | A | * | 2/1959 | La Rue et al. | 24/103 |
| 2,944,311 | A | * | 7/1960 | Schneckenberger | 24/104 |
| 3,142,878 | A | * | 8/1964 | Santora | 24/96 |
| 3,303,543 | A | * | 2/1967 | La Rue et al. | 24/104 |
| 3,979,802 | A | | 9/1976 | Bongartz et al. | |
| 4,097,969 | A | * | 7/1978 | Nysten | 24/114.7 |
| 4,597,206 | A | * | 7/1986 | Benson | 40/1.5 |
| 4,662,034 | A | | 5/1987 | Cunningham | |
| 4,959,890 | A | | 10/1990 | Pazurek | |
| 5,101,541 | A | | 4/1992 | Watanabe | |
| 5,107,573 | A | * | 4/1992 | Zhang | 24/706.4 |
| 5,175,911 | A | | 1/1993 | Terrels et al. | |
| 5,293,670 | A | * | 3/1994 | Watanabe | 24/114.3 |
| 5,435,043 | A | | 7/1995 | Ito et al. | |
| 5,566,426 | A | * | 10/1996 | Lu | 24/102 PL |
| 5,584,104 | A | * | 12/1996 | Stuart | 24/114.7 |
| 5,671,507 | A | * | 9/1997 | Deschenes et al. | 24/114.7 |
| D410,412 | S | | 6/1999 | Tominaga et al. | |
| 5,954,242 | A | * | 9/1999 | Deschenes et al. | 223/1 |
| 6,702,162 | B1 | * | 3/2004 | Hassid | 223/1 |
| 7,846,180 | B2 | * | 12/2010 | Cerier | 606/232 |

* cited by examiner

*Primary Examiner* — Robert J Sandy
*Assistant Examiner* — David Upchurch
(74) *Attorney, Agent, or Firm* — Robert C Montgomery; Montgomery Patent and Design

(57) ABSTRACT

A removably attachable button includes a pin assembly and a cap assembly. The pin assembly has a pair of pins which releasably engage the cap assembly. The cap assembly has a front surface which has the appearance of a button and a rear surface which accepts the pin assembly. The button is utilized to embellish or to replace a missing button on a piece of clothing without needing to access sewing equipment.

5 Claims, 3 Drawing Sheets

REMOVABLY ATTACHABLE BUTTON

RELATED APPLICATIONS

The present invention was first described in and claims the benefit of U.S. Provisional Application No. 61/374,142 filed on Aug. 16, 2010, the entire disclosures of which are incorporated herein by reference.

FIELD OF THE INVENTION

The present invention relates generally to a closure fastener for an article of clothing, and in particular, to a removably attachable button for temporary or permanent use with an article of clothing.

BACKGROUND OF THE INVENTION

There are a wide variety of attachment methods used upon our clothing, such as zippers, snaps, and the like. Perhaps the most common of these methods is the use of a button and a corresponding button hole. The button has been used for countless generations for quickly and easily securing clothing.

Unfortunately, buttons are prone to failing. Generally speaking, buttons fail when the threads holding them in place break due to repeated use or becoming caught on another object. This detachment usually occurs at the most inopportune time when an article of clothing is needed the most.

Failure of a button requires a user to either take valuable time to sew the button back on or find an alternate piece of clothing. Many people do not possess suitable seamstress skills, thus forcing a costly repair or an even costlier replacement of the entire item of clothing. In many cases, even when the user is capable of repairing the clothing themselves, they will not have appropriate equipment on hand at the time of failure. Accordingly, there exists a need for a means by which buttons can be replaced on clothing in order to increase the useful lifetime of the clothing.

Various attempts have been made to provide fasteners providing button-type functionality. Examples of these attempts can be seen by reference to several U.S. patents, such as U.S. Pat. No. 3,979,802; U.S. Pat. No. 4,662,034; U.S. Pat. No. 4,959,890; U.S. Pat. No. 5,101,541; U.S. Pat. No. 5,175,911; and U.S. Pat. No. 5,435,043.

While these devices fulfill their respective, particular objectives, each of these references suffer from one or more disadvantages. Many such devices are not secure and are prone to coming off under minor stress. Many such devices are not robust enough to be suitable for long-term use. Many such devices cannot be prevented from rotating after they are installed. Accordingly, there exists a need for an attachable fastening device replacing buttons on clothing without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a button-replacing attachable fastener for clothing which provides a secure and commensurate replacement for the button in a manner suitable for short-term or long-term use. Thus, the object of the present invention is to solve the aforementioned disadvantages and provide for this need.

To achieve the above objectives, it is an object of the present invention to provide a means for temporarily or permanently replacing a broken button on an article of clothing. The apparatus comprises a cap assembly and a pin assembly that can be fabricated of various materials and designs to match a variety of button styles.

Another object of the present invention is to provide the appearance of a conventional button such that the device is indistinguishable from existing buttons on the same article of clothing. In the preferred embodiment, the cap front surface includes a plurality of apertures which imitate the sewing apertures on a button.

Yet still another object of the present invention is to comprise a rear surface of the cap having a pair of receiving means that correspondingly engage end tips of the pin assembly.

Yet still another object of the present invention is to comprise the pin assembly having a generally "U"-shaped body with each end tip of the pin comprising a sharpened end for puncturing insertion through a clothing item. In this manner, the pin assembly is placed through a desired location in the clothing and the cap assembly is placed on the other side of the fabric to engage the end tips.

Yet still another object of the present invention is to comprise each end tip of a shape correspondingly engaging the receiving means of the cap assembly, such that the pin can be depressed inwardly, placed against the cap, and released to securely engage the receiving means via a secure interference fit.

Yet still another object of the present invention is to provide a method of utilizing the device that provides a unique means of acquiring the device, pushing the pin assembly through a desired clothing item, inwardly depressing the pin body to insert each tip each receiving means on the cap rear surface, utilizing the device similarly to a conventional button, removing the device as desired, and, providing a quick remedy for lost buttons on an article of clothing.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
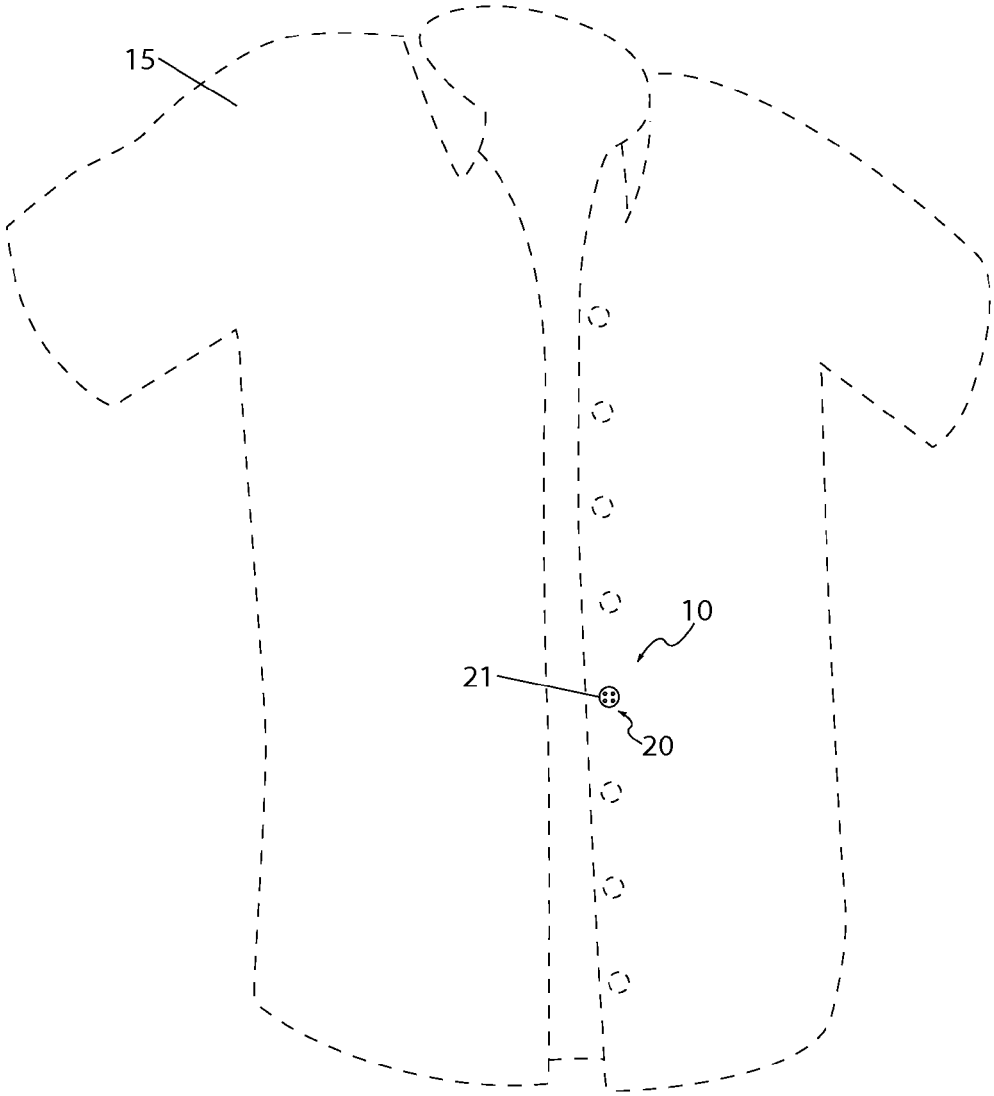
FIG. 1 is an environmental view of a removably attachable button, according to a preferred embodiment in accordance with the invention.

10 removably attachable button
15 clothing item
20 cap assembly
21 cap front surface
22 accessory aperture
23 cap rear surface
24 receiving means
25 interior portion
30 pin assembly
31 pin body
32 tip

DETAILED DESCRIPTION OF THE PREFERRED EMBODIMENT

Figure 2:
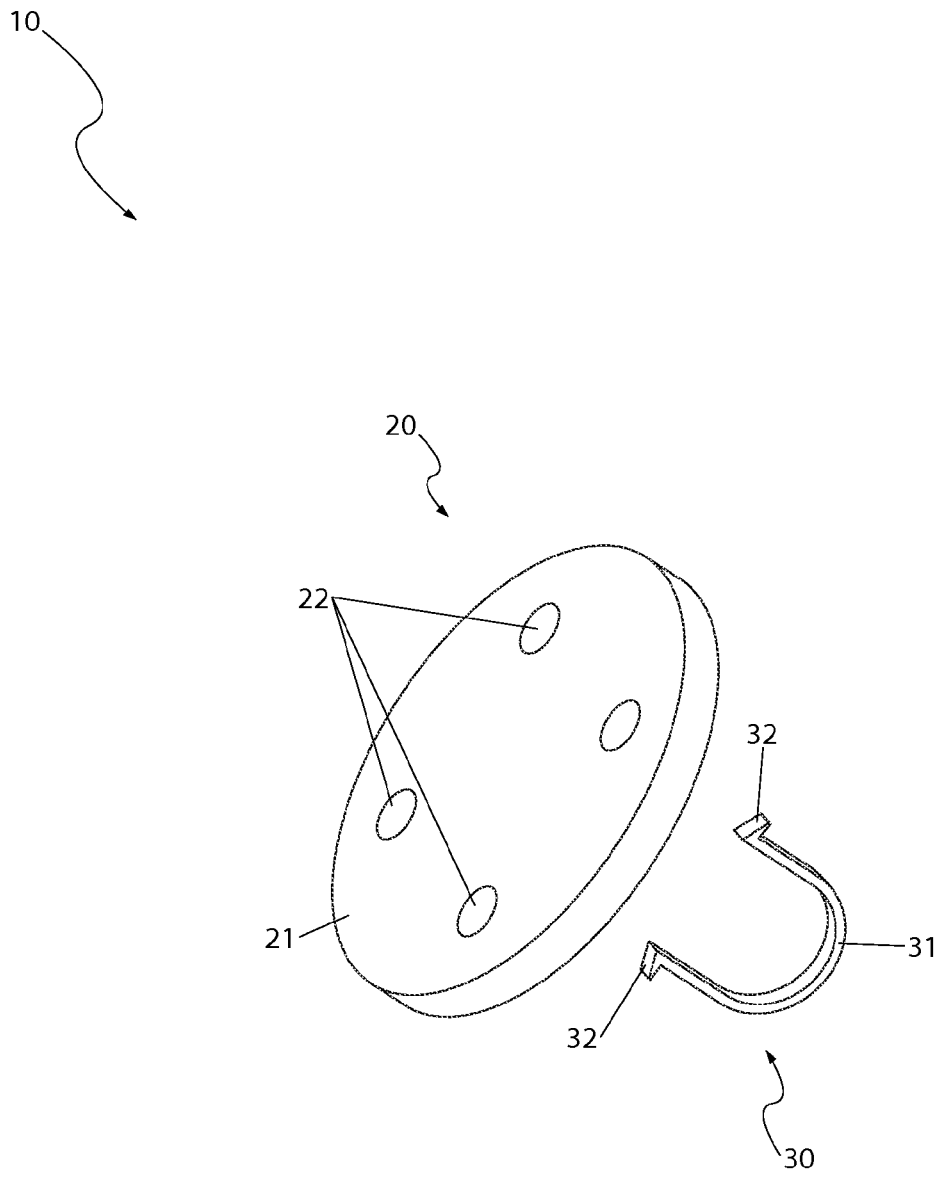
FIG. 2 is a front perspective view of the removably attachable button, according to the preferred; and, FIG. 3 is a rear perspective view of the removably attachable button, according to the preferred embodiment.
Figure 3:
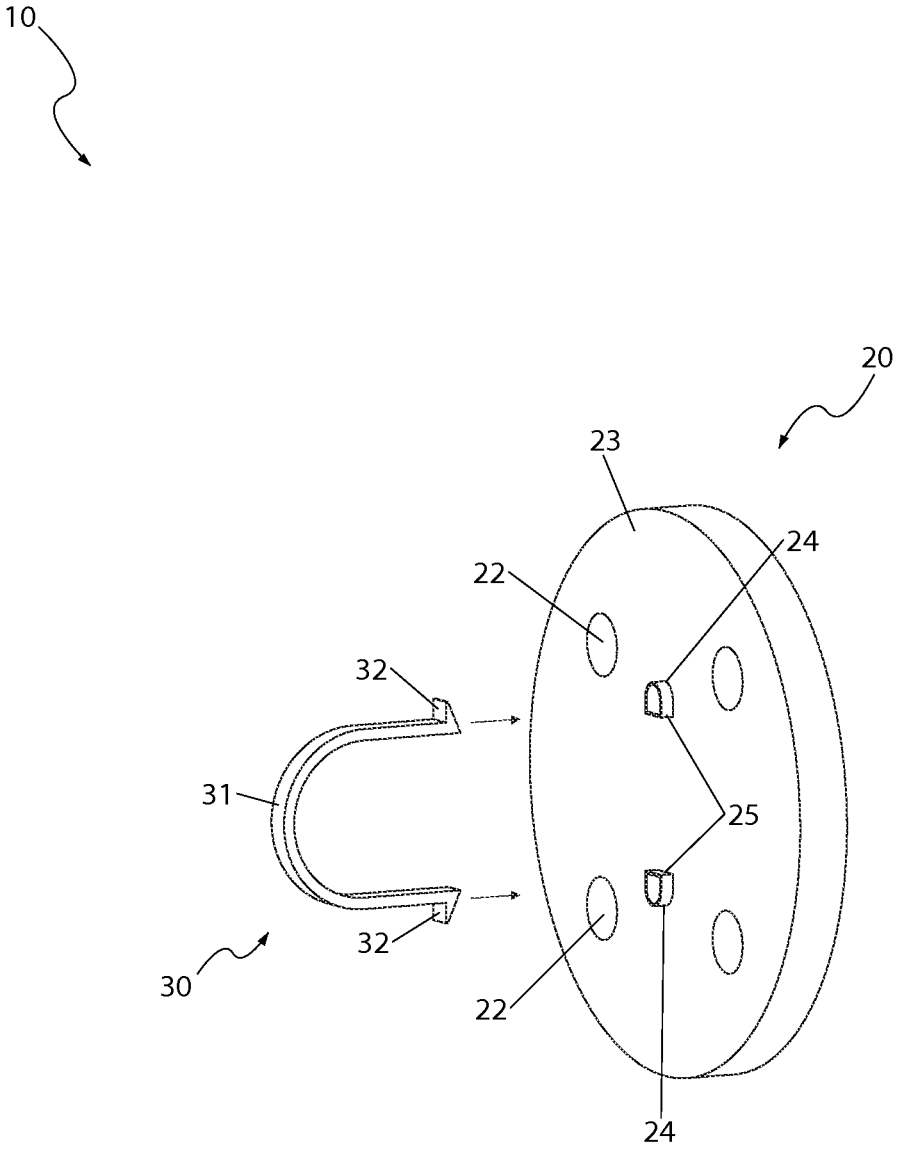

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 3, depicting a removably attachable button (herein described as a "device") 10, where like reference numerals represent similar or like parts. In accordance with the invention, the present disclosure describes a device 10 which provides a means for a temporary or a permanent button replacement for garments without the need for sewing equipment.

FIG. 1 shows an environmental view of the device 10. The device 10 replaces a lost or disconnected fastener, such as a button, located on clothing items 15 such as, but not limited to: jackets, purses, shirts, slacks, or the like. The device 10 can also be utilized to embellish a desired clothing item 15. The device 10 includes a cap assembly 20 and a pin assembly 30 which are fabricated of various materials to correspond with a variety of button styles.

FIG. 2 shows a front perspective view of the device 10 and FIG. 3 a rear perspective view of the device 10. The cap assembly 20 provides an appearance of a conventional button. The cap assembly 20 includes a cap front surface 21 and a cap rear surface 23. The cap assembly 20 is depicted having a cylindrical-shape for illustration purposes only and it can be appreciated that other shapes, characters, or the forms can be utilized with limiting the scope of the device 10. The cap assembly 20 is fabricated from materials such as, but not limited to: plastic, metal, stone, or the like and made available in various shapes, colors, or patterns. Further, the cap assembly 20 can comprise decorative colors or indicia to provide a fashionable look to the clothing item 15.

The cap front surface 21 mimics an existing button and includes a plurality of accessory apertures 22 which imitate the sewing apertures of standard sewn-on buttons. The accessory apertures 22 are for appearance purposes to mimic the look of the sewn-on button. The cap rear surface 23 includes a pair of opposing receiving means 24 which provide an attachment to the pin assembly 30 which is utilized to secure the device 10 onto the desired clothing item 15. Each receiving means 24 takes the form of an integrally molded hemispherical-shape protrusion disposed on the cap rear surface 23. The protrusions have opposing open ends and a closed top which defines a hollow interior portion 25. Opposing end tips 32 of the pin assembly 30 are inserted into the interior portions 25 of the protrusions 24 to secure the pin assembly 30 to the cap assembly 20.

The pin assembly 30 is utilized to attach the cap assembly 20 onto a selected location upon the clothing item 15. The pin assembly 30 includes a pin body 31 and a pair of opposing tips 32. The pin assembly 30 is fabricated from resilient materials such as, but not limited to: plastic, metal, or the like. The pin body 31 includes a "U"-shape which enables the pin assembly 30 to be depressed and the tips 32 to be inwardly deflected when engaging each tip 32 within the opposing protrusions 24. The "U"-shape is naturally biased back to a non-deflected position when pressure is released to maintain the tips 32 within the hollow interior portion 25. Each tip 32 includes a sharpened end which provides a puncturing means for insertion into the clothing item 15 and enables the pin assembly 30 to be attached to the cap assembly 20.

The width between the protrusions 24 is slightly smaller than the width between the tips 32 to enable a proper attachment. Each tip 32 engages the interior portion 25 of each protrusion 24 and secures the pin assembly 30 to the cap assembly 20 and clothing item 15. In use, the pin body 31 is forced through the clothing item 15 and is depressed inwardly to deform the pin assembly 30 and align each tip 32 with each receiving member 24. Once released the tips 32 become entrapped within the hollow interior 25 of the open end of the protrusions 24.

It can be appreciated by one skilled in the art that other styles and configurations of the invention can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it is installed and utilized as indicated in FIGS. 1 through 3.

The method of utilizing the device 10 may be achieved by performing the following steps: acquiring the device 10; puncturing the pin assembly 30 into the selected location upon the clothing item 15; inwardly depressing the pin body 31 to align and insert each tip 32 into the interior portions 25 of each protrusion 24 on the cap rear surface 23; utilizing the device 10 similar to a conventional button; removing as desired; and, providing a means to quickly repair lost buttons on an article of clothing.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A removably attachable button comprising:

a cap assembly having a perimeter edge, a front surface, a rear surface with a first receiving means having a first interior portion and a second receiving means having a second interior portion; and a U-shaped pin assembly having a first tip with a first sharpened end for passing into said first interior portion and a second tip with a second sharpened end for passing into said second interior portion;

wherein said pin assembly is comprised of a resilient material sufficiently strong such that said first tip and said second tip can be inserted through an article of clothing;

wherein said first tip is inwardly deflected when said first tip is fit into said first interior portion;

wherein said second tip is inwardly deflected when said second tip is fit into said second interior portion;

wherein pin assembly bias retains said first tip in said first interior portion and said second tip in said second interior portion; and, wherein said first and second receiving means each further comprises a generally semi-circular form having a closed side, an open side facing outwardly opposite from said rear surface, and a closed top surface defining a hollow interior portion.

2. The button of claim 1, wherein each of said pin assembly tips further comprises an outwardly projecting edge; and, wherein each of said outwardly projecting edges insertingly engages said opposing protrusion open sides when said pin assembly is coupled to said cap assembly.

3. The button of claim 1, wherein said cap assembly front surface further comprises a plurality of accessory apertures.

4. The button of claim 3, wherein said cap assembly front surface is substantially flat.

5. The button of claim 3, wherein said cap assembly rear surface is substantially flat.

* * * * *